US005403087A

United States Patent [19]

Irie et al.

[11] Patent Number: 5,403,087

[45] Date of Patent: Apr. 4, 1995

[54] MIXING APPARATUS AND MIXING METHOD FOR MIXING FIBROUS AND POWDER MATERIALS

[75] Inventors: Shoichiro Irie; Motonobu Abe; Norihito Akiyama, all of Yokohama, Japan

[73] Assignees: Ask Corporation; Sanshin Thermal Insulation Co., Ltd., both of Yokohama, Japan

[21] Appl. No.: 174,519

[22] Filed: Dec. 28, 1993

[30] Foreign Application Priority Data

May 25, 1993 [JP] Japan ..... 5-122464

[51] Int. Cl.[6] ..... B28C 5/14; B01F 7/04

[52] U.S. Cl. ..... 366/66; 366/196; 366/300; 366/301; 366/325

[58] Field of Search ..... 366/66, 76, 79, 81, 366/83–85, 90, 96–99, 194–196, 297–301, 307, 319, 325–329, 345; 425/204, 209; 416/228

[56] References Cited

U.S. PATENT DOCUMENTS

| | | | |
|---|---|---|---|
| 56,520 | 7/1866 | Brigham | 366/328 X |
| 120,097 | 10/1871 | Potter | 416/228 |
| 155,212 | 9/1874 | White | 366/64 |
| 199,474 | 1/1878 | Sprague | 366/328 |
| 3,650,510 | 3/1972 | Ansel | 366/325 X |
| 3,895,781 | 7/1975 | Lodige et al. | 366/300 X |
| 4,019,723 | 4/1977 | Urbanczyk | 366/345 X |
| 4,176,969 | 12/1979 | Wallace et al. . | |
| 4,281,934 | 8/1981 | Krause et al. | 366/326 X |
| 4,438,634 | 3/1984 | Merle et al. | 366/326 X |

FOREIGN PATENT DOCUMENTS

| | | | |
|---|---|---|---|
| 0055193 | 6/1982 | European Pat. Off. . | |
| 319458 | 7/1934 | Italy | 366/300 |
| 91538 | 11/1921 | Switzerland | 366/328 |
| 2249269 | 5/1992 | United Kingdom . | |

*Primary Examiner*—David A. Scherbel
*Assistant Examiner*—Charles Cooley
*Attorney, Agent, or Firm*—Oblon, Spivak, McClelland, Maier, & Neustadt

[57] ABSTRACT

Mixing method and apparatus using two shafts which rotate in a reverse direction with respect to each other, having mixing pins branched in a V shape or Y shape and a mixing bath arranged in such manner that fibrous and powder materials are input to one end, and mixed while being moved along the length of the shafts with the obtained mixture being discharged at the other end. A mixing appratus and mixing method allows for uniformly mixing fibrous material, particularly semi-wetted fibrous material with powder material with high efficiency.

8 Claims, 3 Drawing Sheets

MIXING APPARATUS AND MIXING METHOD FOR MIXING FIBROUS AND POWDER MATERIALS

The present invention relates to a mixing apparatus for mixing fibrous and powder materials uniformly with high efficiency and a mixing method for fibrous and powder materials employing the apparatus, and more particularly to a mixing apparatus for mixing the fibrous and the powder materials uniformly at high efficiency so that the powder material adheres to the surface of a semi-wetted fibrous material (wetted without water seeping out even if it is pressurized with low pressure) without damaging the fibrous material and also to a mixing method for fibrous and powder materials employing the apparatus.

DISCUSSION OF THE BACKGROUND

Currently used mixing apparatus for mixing fibrous and powder materials may be exemplified by Omni mixers and Eirich Intensive mixers. The Omni mixer is an apparatus fitted with flexible rubber bowl on its oscillating plate without agitating blades, which performs mixing by diffusion by accelerating materials to be mixed and changing their speed and direction of movement, scattering them in random directions. The Omni mixer is suitable for batch mixing, but is not suitable for continuous mixing. The motion of the Omni mixer includes mixing by convection, shearing and diffusion. When a shearing force is applied to the material being mixed, the material may be damaged and if the fibrous material is fine, the fibers may become entangled during mixing, thus hindering uniform mixing of the fibrous and powder materials.

The Eirich Intensive mixer uses special blades in its cylindrical container and is suitable for mixing in batch but not for continuous mixing. In the Eirich intensive mixer, a load may be applied to the material and in the case of the fibrous material in particular, there may be problems such as damage to the material.

A pin-type continuous mixing apparatus, suitable for continuous mixing is described in Japanese Patent Laid-open No. 63-49238. However, this apparatus is directed towards adding liquid to powder and making it uniform, but not towards mixing the fibrous material and powder uniformly. Based on its structure of a plurality of mixing pins (having a ground face) fixed to a rotating shaft at right angles, it is not always sufficiently suitable for uniformly mixing fibrous material and powder material.

Other prior art includes the mixing apparatus disclosed in Japanese Patent Publication Nos. 59-51329 and 63-54416. However, in these apparatuses, a considerable load is applied to the material and, for example, if at least one of the materials has been semi-wetted, too much load is applied to the materials during mixing, throughout or locally, so that water is squeezed out of the semi-wetted material, thereby sometimes disturbing uniform mixing and damaging the material. Thus these apparatuses are not suitable for continuous mixing.

Although when mixing raw materials such as fibrous and powder materials, it is important to mix them uniformly without damaging the fibrous material, the apparatus described above may damage the fibrous material during mixing; therefore they are not suitable as apparatuses for continuously mixing fibrous and powder materials uniformly.

SUMMARY OF THE INVENTION

Accordingly, an object of the present invention is to provide an apparatus and method for mixing the fibrous material, particularly for mixing semi-wetted fibrous and powder materials uniformly with high efficiency.

According to one aspect of the present invention, there is provided an apparatus for mixing fibrous and powder materials, especially to coat semi-wetted fiber with dry powder, said apparatus comprising two shafts which rotate in reverse direction to each other with mixing pins mounted on each shaft, said pins having a bifurcated form and thus for example branching into a V shape or Y shape, and a mixing bath arranged in such a manner that fibrous and powder materials are charged into one end of the bath and mixed while being moved along the length of said shafts, the obtained mixture being discharged at the other end of the bath.

According to another aspect of the present invention, there is provided a mixing method for fibrous and powder materials, comprising the steps of: charging the fibrous and powder materials to a material-input side of a mixing apparatus for mixing the fibrous material and powder material comprising two shafts which rotate in reverse to each other with mixing pins mounted on each shaft, said pins having a bifurcated form as above, and a mixing bath arranged in such a manner that said fibrous and powder materials are charged into one end of the bath mixing said materials while being moved along the length of said shafts which rotate in a reverse to each other; and discharging said obtained mixture from the other end of the bath.

Other features of the invention in preferred form are set out in the claims herein, to which reference should be made. The following describes particular embodiments by way of example.

DESCRIPTION OF THE PREFERRED EMBODIMENTS

The advantage of the mixing apparatus according to the present invention is derived from the configuration of the mixing pins which branch into a V shape or Y shape that are mounted on the two shafts which turn in a reverse direction with respect to each other, the V shape or Y shape making it possible to uniformly mix fibrous material with other, powder material without damaging the fibrous material, particularly for attaining an effective uniform mixing of semi-wetted fibrous and powder materials.

EXAMPLES

EXAMPLE 1

Figure 1:
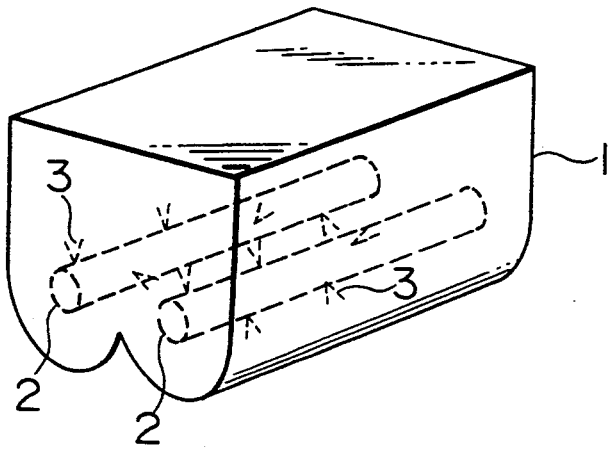
FIG. 1 is a schematic view of an example of a mixing apparatus of the present invention.

One example of a mixing apparatus of the present invention, with the shafts supported at both ends, will be described with reference to the attached drawings. FIG. 1 is a schematic drawing showing an example of the mixing apparatus of the present invention. A mixing bath (1) has two shafts (2) which turn in a direction reverse to each other. The surfaces of the two shafts (2) have a plurality of mixing pins (3) mounted perpendicular to the circumference thereof.

Figure 2:
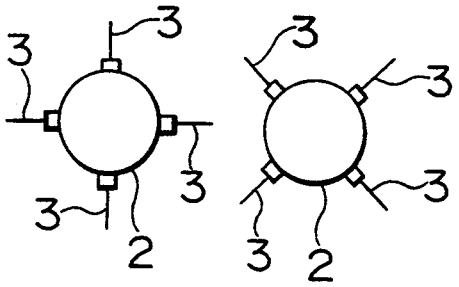
FIG. 2 is an end elevational view illustrating an example of an engagement of mixing pins fixed to two shafts.
Figure 3:
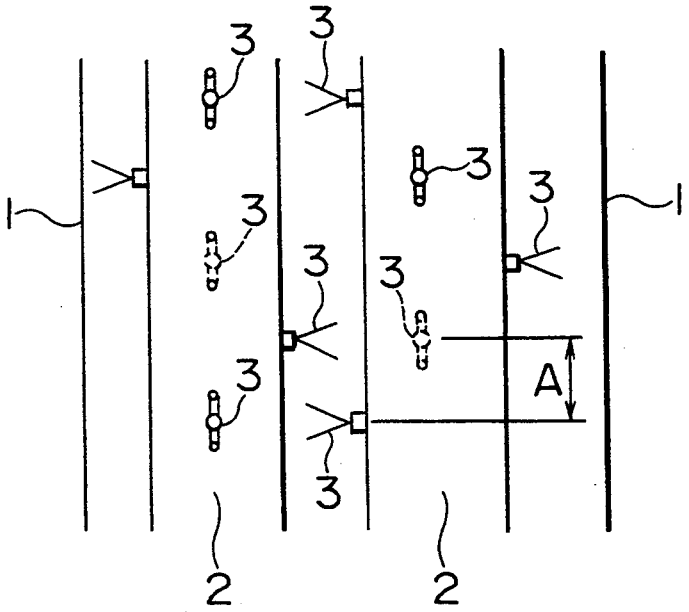
FIG. 3 is a plan view illustrating an example of an engagement of mixing pins fixed to two shafts.

The mixing pins (3) are shaped in a V or Y form. Using mixing pins shaped in such a form allows fibrous and powder materials to be mixed uniformly without much load being applied to the fibrous material, namely without damaging the shape of the fibrous material. If the branch angle of the V or Y shape of the mixing pins (3) is narrower than 15° or wider than 100°, the full effect of using branched mixing pins will be difficult to attain. The desirable mixing pin (3) mounting positions on the two shafts which turn in a reverse direction to each other, namely the engagements of the mixing pins, are shown in FIG. 2 when viewed in shaft cross section. The arrangement of the mixing pins (3) along the length of the shaft (2) is desirably formed as shown in FIG. 3. For simplification's sake, FIGS. 2 and 3 show that the mixing pins (3) are mounted with the planes formed by their V or Y shapes are parallel to the axis of the shaft (2). The sectional shape of the mixing pin (3) is arbitrary and not limited to any particular shape. Further, although the mixing pins (3) may be used together with well known paddles, the percentage of mixing pins (3) is desirably more than 50% with respect to the entire number of mixing pins and paddles.

Figure 4:
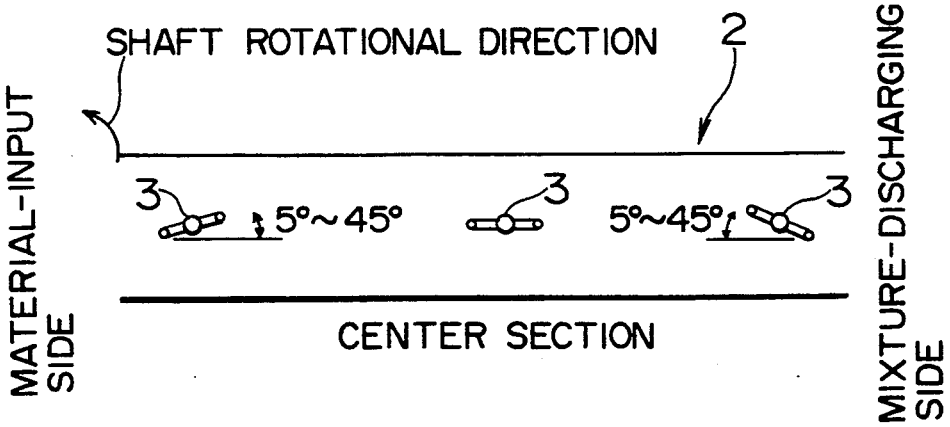
FIG. 4 is a diagram illustrating the relationship between the angle of the plane formed by the V shape or Y shape of mixing pin with the shaft axis and the positions where the mixing pins are fixed in the shaft.

In order to achieve effective mixing of fibrous and powder materials by the mixing pins (3) fixed on the shaft (2), as shown in FIG. 4, the mixing pins (3) disposed on the material-input side (i.e. end of the bath) for fibrous and powder materials are desirably fixed to the shaft (2) at such an angle that the planes formed by the V shape or Y shape of the mixing pins (3) act to push fibrous and powder materials to the material-input side when the shafts (2) are rotated. This angle may be 5° to 45°, preferably 10° to 30°, to the axis of the shaft (2). This angle can be made larger for mixing pins nearer the material-input side and smaller as they are near the midpoint of the shaft. Needless to say, the angle of the plane formed by the V or Y shapes of the mixing pins (3) have reverse inclination depending on the shaft because the two shafts are rotating in reverse to each other. By setting the planes formed by the V or Y shapes of the mixing pins (3) at an angle which permits the materials to be pushed back when the shafts (2) are rotated, material input on the material-input side is subject to a push back force. Since this force is weak, continuously inputting the material makes the material feed along the length of the shaft (2) toward the material-discharge side while it is being mixed. This operation is due to use of mixing pins (3) which are shaped in a V or Y form. The percentage of the mixing pins (3) fixed at such an angle is e.g. 10% to 45%, preferably about 30%, located on the material-input side of the shaft (2).

In order to collect the obtained material mixture effectively, the mixing pins (3) located on the material-discharging side are desirably fixed to the shafts at such an angle that the planes formed by the V or Y shapes of the mixing pins (3) act to push the mixture toward the material-discharge side when the shafts (2) are rotated. As before the angle is 5° to 45° to the axis of the shaft (2) and preferably 10° to 30°. This angle is made smaller for the mixing pins nearer the midpoint of the shafts and may be made larger for pins nearer the material-discharge side. The percentage of mixing pins fixed at such an angle is e.g. 10 to 45%, located on the material-discharging side and preferably about 30%.

Further, the mixing pins (3) to be located in the midpoint of the shaft between the material-input side and the material-discharging side is desirably fixed to the shaft (2) so that the plane formed by the V shape or Y shape of the mixing pin is in parallel to the lengthwise direction of the shaft (2). The percentage of mixing pins fixed at such an angle is e.g. 10% to 80%, located at the midpoint between the material-input side and the material-discharge side of the shaft (2) and preferably about 40%.

In the mixing apparatus of the present invention, the mixing bath and the shaft may be tilted so as to position the material-input side higher than the material-discharge side. In this case, the angle of tilt is desirably 20° or less. A larger tilt angle than this may cause insufficient mixing.

The mixing apparatus comprises the mixing bath (1) including the two shafts (2) having the mixing pins shaped as described above. The shafts (2) are rotated in reverse to each other and the fibrous and powder materials are input into the mixing bath (1) through one end where the shafts are supported. The materials are moved along the length of the shaft (2) and mixed, and the obtained mixture is taken out from the other end where the shafts are supported. The fibrous material and powder materials can be moved along the shaft (2) by tilting the mixing bath (1) with respect to the length of the shaft (2) or feeding the materials and discharging the obtained mixture continuously.

In the mixing apparatus of the present invention, a material supply means to the material-input side and a discharging means of the discharging side are not limited. For example, by using a belt conveyor, the material may be continuously supplied from the material-input side and already mixed material may be taken out using a belt conveyer installed on the material-discharge side and transferred to any further process.

The mixing apparatus of the present invention may be arranged so that a plurality of mixing apparatuses are placed in parallel or in series depending on the purpose and processing capacity of the mixing bath (1) configured as described above.

EXAMPLE 2

Bamboo fiber and cement were mixed using the mixing apparatus shown in FIG. 1. The specifications of the mixing apparatus were as follows:

Mixing bath: 1 m in width×4 m in length×1.5 m in height (internal dimension)

Shaft: 165.2 mm in diameter×3.9 m in length

Figure 5:
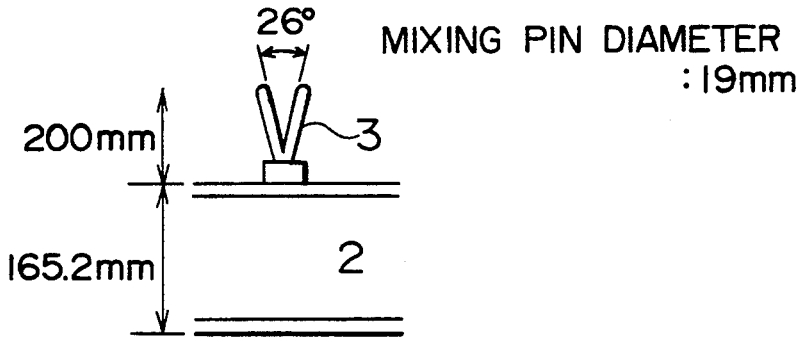
FIG. 5 is a view illustrating the shape and dimensions of a mixing pin used in example 2.

Shape and dimensions of the mixing pins: as shown in FIG. 5

Mixing pin arrangement: the mixing pins were fixed at intervals of 150 mm along the length of the shaft (A in FIG. 3) and each were shifted 90° along the shaft circumference. The planes formed by the V shapes of the mixing pins (1.2 m away from each end) located on the material-input and -discharge sides were angled at 20° to the axis of the shaft and the mixing pins located in a 1.5 m long center section were in parallel to the shaft axis.

Figure 6:
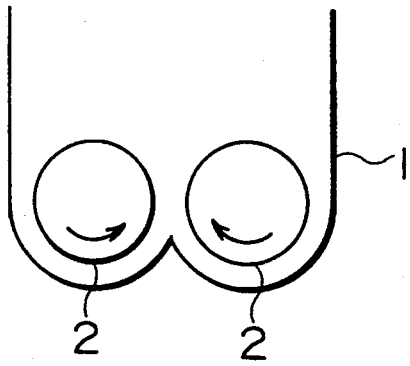
FIG. 6 is a view illustrating the outline of a mixing apparatus used in example 2 and the rotating directions of the shafts.

By rotating the two shafts (2) of the mixing apparatus provided with the mixing bath shaped as described above in the directions shown in FIG. 6 at 75 rpm, semi-wetted bamboo fiber (percentage of water content: 150%, average diameter: 0.2 mm average length: 25 mm) and normal Portland cement (JIS R5210) were continuously supplied to one end where the shafts (2) were supported, at the rate of 16 kg and 19 kg per minute respectively, by means of a belt conveyer and mixed, and the obtained mixture was discharge from the opposite end where the shafts were supported. As a result, cement adhered to the surface of the bamboo fiber uniformly, from which it was confirmed that the materials had been mixed sufficiently equally. Additionally, no damage was observed in the bamboo fiber.

The present invention can provide an apparatus and method for mixing fibrous material, particularly, semi-wetted fibrous and powder materials uniformly at high efficiency.

What is claimed is:

1. Mixing apparatus for mixing fibrous and powder materials, said apparatus comprising:

two shafts which rotate in respective directions which are reverse to each other and which have a plurality of mixing pins mounted on each shaft, said pins having a bifurcated form, and a mixing bath within which said shafts are positioned wherein said bath is arranged in such a manner that said fibrous and powder materials are input into a material discharging end of the bath and mixed while being moved along the length of said shafts, an obtained mixture being discharged at a material discharging end of the bath wherein first mixing pins of said plurality of mixing pins which are located towards the material charging end of the bath are respectively fixed to said shafts at such an angle that planes formed by bifurcations of said first mixing pins act to push the fibrous and powder materials towards the material charging end when said shafts are rotated and second mixing pins of said plurality of mixing pins which are located towards the material discharging end of the bath are respectively fixed to said shafts so that planes formed by the bifurcations of said second mixing pins act to push the mixture towards said material discharging end when said shafts are rotated.

2. Mixing apparatus according to claim 1, wherein at least some of said pins branch out from each of said shafts and form an angle of from 15° to 100° with respect to an axis of each of said shafts.

3. Mixing apparatus according to claim 1, wherein said planes are respectively at an angle of 5°–45° to an axis of each of said shafts.

4. Mixing apparatus according to claim 3, which comprises third mixing pins of said plurality of pins which are located at a midpoint between said material charging end and said material discharging end and are respectively fixed to said shafts so that planes formed by the bifurcations of said third mixing pins are respectively parallel to the axes of said shafts.

5. Mixing method for mixing fibrous and powder materials, in a mixing apparatus having two shafts which respectively rotate in reverse directions and said shafts each having a plurality of bifurcated pins mounted thereon, and a mixing bath within which the shafts are positioned, comprising the steps of:

charging the fibrous and powder materials to a material-input side of the bath for mixing the fibrous material and powder material;

mixing said materials with the pins while the materials are being moved along the length of said shafts and rotating said shafts in said reverse directions;

discharging an obtained mixture from a material discharging end of the bath:

positioning first mixing pins of said plurality of bifurcated pins so as to be located towards a material charging end of the bath such that planes formed by bifurcations of said first mixing pins act to push the fiberous and powder materials towards the material charging end when said shafts are rotated; and positioning second pins of said plurality of bifurcated pins towards the material discharging end of the bath so that said second mixing pins act to push the mixture towards the material discharging end when said shafts are rotated.

6. A mixing method as claimed in claim 5, which comprises positioning at least some of the pins so as to branch out from each of the shafts at an angle of from 15° to 100° with respect to an axis of each of the shafts.

7. A mixing method as claimed in claim 5, which comprises positioning at least some of the pins so that planes of said at least some of the pins branch out from each of the shafts at an angle of from 5° to 45° with respect to an axis of each of the shafts.

8. A mixing method as claimed in claim 5, which comprises positioning third mixing pins of said plurality of bifurcated pins between said material charging end and said material discharging end so that planes formed by the bifurcations of said third mixing pins are respectively parallel to an axis of each of said shafts.

* * * * *